US009135861B2

(12) United States Patent
Lee

(10) Patent No.: US 9,135,861 B2
(45) Date of Patent: Sep. 15, 2015

(54) ORGANIC LIGHT EMITTING DEVICE AND METHOD OF CONFIGURING GAMMA SET OF THE SAME

(71) Applicant: Samsung Display Co., LTD., Yongin, Geonggi-do (KR)

(72) Inventor: Jin Seok Lee, Suwon-si (KR)

(73) Assignee: Samsung Display Co., Ltd., Giheung-Gu, Yongin, Gyeonggi-Do (KR)

( * ) Notice: Subject to any disclaimer, the term of this patent is extended or adjusted under 35 U.S.C. 154(b) by 351 days.

(21) Appl. No.: 13/861,886

(22) Filed: Apr. 12, 2013

(65) Prior Publication Data

US 2013/0271515 A1 Oct. 17, 2013

(30) Foreign Application Priority Data

Apr. 17, 2012 (KR) ..... 10-2012-0039854

(51) Int. Cl.
*G09G 5/02* (2006.01)
*G09G 3/32* (2006.01)

(52) U.S. Cl.
CPC ..... *G09G 3/3291* (2013.01); *G09G 2320/0673* (2013.01)

(58) Field of Classification Search
CPC ..... G09G 2320/0673; G09G 2320/0276; G09G 3/3291; G09G 3/3208
See application file for complete search history.

(56) References Cited

U.S. PATENT DOCUMENTS

2006/0285136 A1* 12/2006 Shin et al. ..... 358/1.9
2007/0052735 A1* 3/2007 Chou ..... 345/690
2008/0211757 A1* 9/2008 Weng et al. ..... 345/89

FOREIGN PATENT DOCUMENTS

KR 10-0555303 B1 2/2006
KR 1020080060438 A * 2/2008
KR 10-2008-0060438 A 7/2008

* cited by examiner

*Primary Examiner* — Aneeta Yodichkas
*Assistant Examiner* — Brent D Castiaux
(74) *Attorney, Agent, or Firm* — Robert E. Bushnell, Esq.

(57) ABSTRACT

An organic light emitting device having an organic light emitting diode (OLED) panel that displays an image corresponding to a data signal, a data driver that receives image data and a gamma voltage and generates the data signal, and a gamma voltage generator that generates a gamma voltage corresponding to one selected from a plurality of gamma sets corresponding to a plurality of coordinates on the color coordinate system, wherein when a first gamma set corresponding to a first coordinate on the color coordinate system and the image data corresponds to the first coordinate, and the OLED panel displays an image corresponding to a second coordinate different from the first coordinate, the gamma voltage generator generates the gamma voltage corresponding to a second gamma set corresponding to a third coordinate symmetrical to the second coordinate with respect to the first coordinate.

20 Claims, 8 Drawing Sheets

ORGANIC LIGHT EMITTING DEVICE AND METHOD OF CONFIGURING GAMMA SET OF THE SAME

CLAIM OF PRIORITY

This application makes reference to, incorporates the same herein, and claims all benefits accruing under 35 U.S.C. §119 from an application earlier filed in the Korean Intellectual Property Office on the $17^{th}$ of Apr. 2012 and there duly assigned Serial No. 10-2012-0039854.

BACKGROUND OF THE INVENTION

1. Field of the Invention

The present invention relates to an organic light emitting device and a driving method thereof, and more particularly, to an organic light emitting device, which can reduce quality deviation between display devices, and a method of configuring a gamma set of the same.

2. Description of the Related Art

In line with the tendency toward lightweightness and slimness of portable display devices such as notebook computers, cellular phones or portable multimedia players (PMPs) as well as displays for home use, such as a TV or a monitor, a variety of flat display devices are widely used. There are various types of flat display devices, including a liquid crystal display device, an organic light emitting device and an electrophorectic display device. Among the flat display devices, the organic light emitting device is increasingly demanded owing to its various advantages, including low power consumption, high brightness, high contrast ratio, and facilitated enabling of a flexible display.

The organic light emitting device implements an image using an organic light emitting diode (OLED) as a light-emitting element. The OLED emits light with brightness corresponding to the current flowing therein. The organic light emitting device includes a plurality of OLEDs and may display an image by controlling gray scales of the respective OLEDs by controlling the current flowing in each OLED. The organic light emitting device may include a plurality of thin film transistors to control the current flowing in each OLED.

Even if organic light emitting devices are manufactured by the same process, they may have different display quality characteristics in view of brightness and color coordinate system due to differences in OLED characteristics of the respective devices. Accordingly, in order to effectively manage quality of the organic light emitting device, it is necessary to reduce a deviation in display quality.

SUMMARY OF THE INVENTION

The present invention provides an organic light emitting device, which can reduce a deviation in display quality.

The present invention also provides a method of configuring a gamma set in an organic light emitting device, which can reduce a deviation in display quality.

The above and other objects of the present invention will be described in or be apparent from the following description of the preferred embodiments.

According to an aspect of the present invention, there is provided an organic light emitting device includes an organic light emitting diode (OLED) panel that displays an image corresponding to a data signal, a data driver that receives image data and a gamma voltage and generates the data signal, and a gamma voltage generator that generates a gamma voltage corresponding to one selected from a plurality of gamma sets corresponding to a plurality of coordinates on the color coordinate system, wherein when a first gamma set corresponding to a first coordinate on the color coordinate system and the image data corresponds to the first coordinate, and the OLED panel displays an image corresponding to a second coordinate different from the first coordinate, the gamma voltage generator generates the gamma voltage corresponding to a second gamma set corresponding to a third coordinate symmetrical to the second coordinate with respect to the first coordinate.

According to another aspect of the present invention, there is provided an organic light emitting device including an organic light emitting diode (OLED) panel that displays an image corresponding to a data signal, a data driver that receives image data and a gamma voltage and generates the data signal, and a gamma voltage generator that generates a gamma voltage corresponding to one selected from a plurality of gamma sets corresponding to a plurality of regions arranged in a matrix type and a first coordinate on the color coordinate system, wherein when a first gamma set corresponding to a first coordinate on the color coordinate system and the image data corresponds to the first coordinate, and the OLED panel displays an image corresponding to a second coordinate different from the first coordinate, the gamma voltage generator generates the gamma voltage corresponding to a second gamma set corresponding to a region including a third coordinate symmetrical to the second coordinate with respect to the first coordinate.

According to still another aspect of the present invention, there is provided a method of configuring a gamma set of an organic light emitting device, the method including storing a plurality of gamma sets corresponding to coordinates on the color coordinate system in a memory, selecting a first gamma set corresponding to a first coordinate on the color coordinate system and inputting image data corresponding to the first coordinate into the organic light emitting device, identifying a position of a second coordinate of an image displayed on the organic light emitting device on the color coordinate system, and selecting a third gamma set corresponding to a third coordinate symmetrical to the second coordinate with respect to the first coordinate.

Embodiments of the present invention provide the following effects and advantages.

That is to say, an organic light emitting device which can reduce a deviation in display quality between products may be provided by reducing a color deviation.

In addition, a driving method of an organic light emitting device which can reduce a deviation in display quality between products may be provided by reducing a color deviation.

BRIEF DESCRIPTION OF THE DRAWINGS

A more complete appreciation of the invention, and many of the attendant advantages thereof, will be readily apparent as the same becomes better understood by reference to the following detailed description when considered in conjunction with the accompanying drawings, in which like reference symbols indicate the same or similar components, wherein.

DETAILED DESCRIPTION OF THE INVENTION

The present invention will now be described more fully hereinafter with reference to the accompanying drawings, in which preferred embodiments of the invention are shown. This invention may, however, be embodied in different forms and should not be construed as limited to the embodiments set forth herein. Rather, these embodiments are provided so that this disclosure will be thorough and complete, and will filly convey the scope of the invention to those skilled in the art. The same reference numbers indicate the same components throughout the specification. In the attached figures, the thickness of layers and regions is exaggerated for clarity.

Hereinafter, embodiments of the present invention will be described in further detail with reference to the accompanying drawings.

Figure 1:
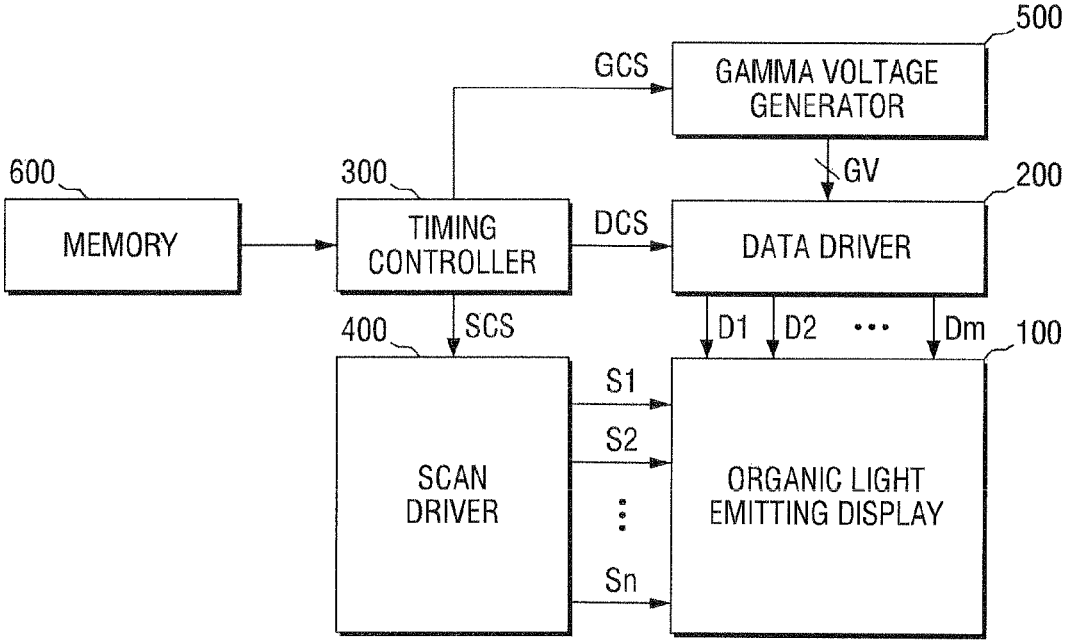
FIG. 1 is a block diagram of an organic light emitting device according to an embodiment of the present invention.

FIG. 1 is a block diagram of an organic light emitting device according to an embodiment of the present invention.

Referring to FIG. 1, the organic light emitting device has an OLED (organic light emitting diode) display 100, a data driver 200, a timing controller 300, a scan driver 400, a gamma voltage generator 500 and a memory 600.

The OLED panel 100 may receive data signals D1, D2, . . . Dm from data driver 200 and scan signals S1, S2, . . . Sn generated by the scan driver 400 to then display an image. The OLED panel 100 includes a plurality of pixels (FIG. 2) and may display an image by controlling gray scales of the plurality of pixels. According to some embodiments, the plurality of pixels may be a set of green, red and blue pixels. According to some other embodiments, the plurality of pixels may be a set of green, red, blue and white pixels. According to some other embodiments, the OLED panel 100 may include a set of pixels having the same color, for example, a set of black-and-white pixels.

A pixel included in the OLED panel 100 will be described in more detail with reference to FIG. 2.

Figure 2:
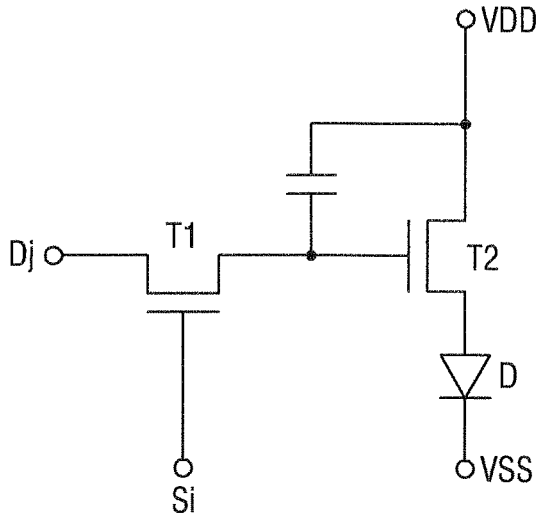
FIG. 2 is a circuit diagram of a pixel included in the organic light emitting device shown in FIG. 1.

FIG. 2 is a circuit diagram of a pixel included in the OLED panel 100 of the organic light emitting diode device shown in FIG. 1.

One pixel of the OLED panel 100 may include an OLED (D), a transistor T1 and a transistor T2.

Transistor T1 may control a data signal Dj corresponding to a scan signal Si to be transmitted to a gate of transistor T2. For example, when the scan signal Si is high, the transistor T1 may transmit the data signal Dj to the gate of the transistor T2, and when the scan signal Si is low, the transistor T1 may prevent the data signal Dj from being transmitted to the gate of the transistor T2.

The transistor T2 may control the current flowing in the OLED (D) in response to the data signal Dj transmitted through the transistor T1. For example, when the data signal Dj is high, the transistor T2 may control the current to flow OLED (D), and when the data signal Dj is low, the transistor T2 may prevent the current from flowing in the OLED (D).

The OLED (D) emits light in response to the current flowing therein. For example, the higher brightness of the light emitted from the OLED (D), the more the current flowing in the OLED (D). Since the respective OLEDs driven with the same current may have different brightness levels and colors, there may be a deviation in the display quality of the organic light emitting device. While FIG. 2 shows that the transistors T1 and T2 are NMOS transistors, aspects of the present invention are not limited thereto. The transistors T1 and T2 may be PMOS or CMOS transistors.

Referring back to FIG. 1, the data driver 200 receives data regarding an image to be displayed on the OLED panel 100 and a gamma voltage GV from gamma voltage generator 500 and generates the data signals D1, D2, . . . , Dm. The data regarding the image to be displayed on the OLED panel 100 may be included in a data control signal DCS from timing controller 300, to be described later. The gamma voltage GV offers a reference for sizes of the data signals D1, D2, . . . , Dm corresponding to gray scale data of the image according to a set gamma curve. Accordingly, the data driver 200 generates the data signals D1, D2, . . . , Dm from the data control signal DCS and the gamma voltage VG and provides the generated data signals D1, D2, . . . , Dm to the OLED panel 100.

The gamma voltage generator 500 generates the gamma voltage GV and provides the same to the data driver 200. The gamma voltage GV may be a set of a plurality of data voltages corresponding to the gray scale data based on a gamma curve set in the organic emitting display device. The number of the gamma voltages GV may be equal to that of gray scales that can be displayed on the OLED panel 100. For example, if the OLED panel 100 can display 256 gray scale levels, the gamma voltage GV may include 256 electric potential levels corresponding to the gray scale levels, respectively, and may receive a gamma control signal GCS from the timing controller 300, to be described later. The gamma voltage generator 500 may change the gamma voltage GV and generate changed gamma voltage so as to correspond to the gamma control signal GCS. The gamma control signal GCS may include information regarding gamma sets, which will be described in more detail with reference to FIG. 3.

Figure 3:
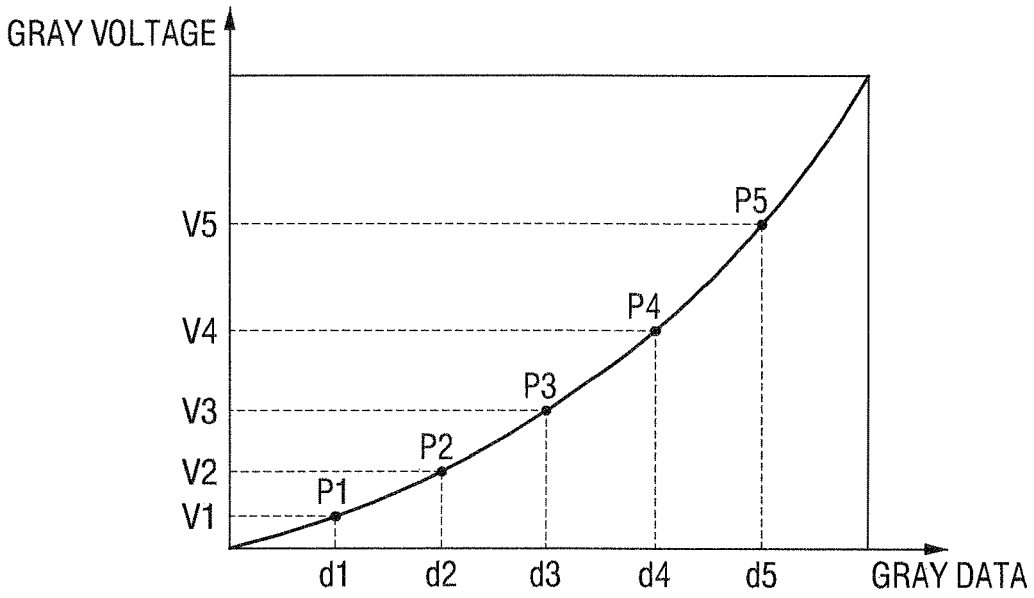
FIG. 3 is a graph illustrating a gamma curve according to an embodiment of the present invention.

FIG. 3 is a graph illustrating a gamma curve according to an embodiment of the present invention.

Referring to FIG. 3, on the gamma curve, the x axis indicates gray scale data and the y axis indicates gray scale voltage. The gamma curve may change according to the configuring method. Thus, in order to reduce the amount of information to be stored, the organic light emitting device may store only the information regarding some positions selected from the gamma curve, instead of gray scale voltages corresponding to all of the gray scale data. For example, the organic light emitting device may store only the information regarding P1 to P5. According to some embodiments, the organic light emitting device may store information regarding d1 to d5, that is, gray scale data of P1 to P5, and V1 to V5 corresponding to d1 to d5, respectively. According to some other embodiments, organic light emitting device may store only the information regarding V1 to V5, and d1 to d5 may be values commonly set for all gamma curves. As described above, a set of data for some of the gamma curves may be referred to as a gamma set. A separate gamma set may be adopted for each of the R, G, B colors. According to some embodiments, the same gamma set may be adopted to each of the R, G, B colors. According to some embodiments, one gamma set may include sub gamma sets for the R, G, B colors.

While FIG. 3 shows that information of five positions, that is, P1 to P5, is extracted to then be stored as gamma sets, aspects of the present invention are not limited thereto. The number of positions on the gamma curve for extracting data may vary according to alternative embodiments.

The gamma curve restored from a gamma set extracted from the gamma curve will be described with reference to FIG. 4.

Figure 4:
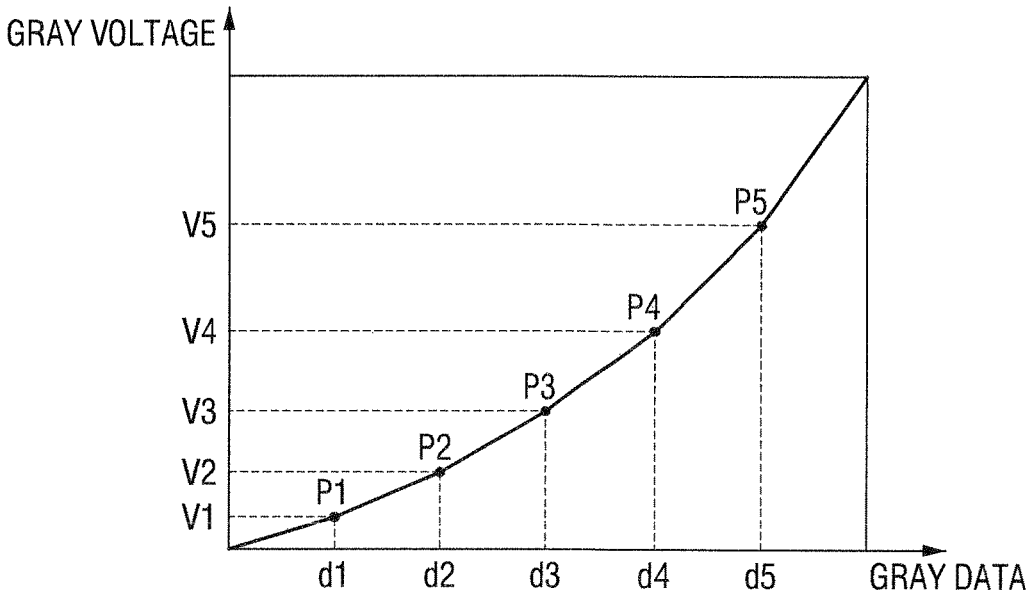
FIG. 4 illustrates a gamma curve restored from a gamma set extracted from the gamma curve shown in FIG. 3.

FIG. 4 illustrates a gamma curve restored from a gamma set extracted from the gamma curve shown in FIG. 3.

Since V1 to V5 and d1 to d5 are stored in the organic light emitting device, P1 to P5 can be restored at the same positions on the gamma curve shown in FIG. 3. Therefore, the gamma curve can be restored in the form of a curve similar to the gamma curve shown in FIG. 3 by sequentially connecting the starting point of the gamma curve to P1 to P5 in straight lines. A plurality of electric potential levels corresponding to the gray scale data included in the gamma voltage GV are arranged on the graph shown in FIG. 4.

The color coordinate system will be described in detail with reference to FIGS. 5 through 8.

Figure 5:
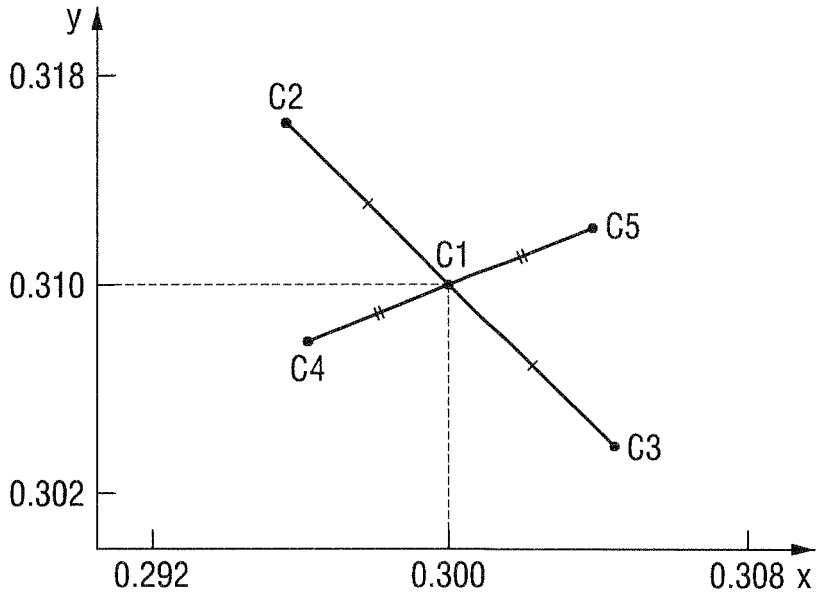
FIG. 5 illustrates the color coordinate system according to an embodiment of the present invention.
Figure 6:
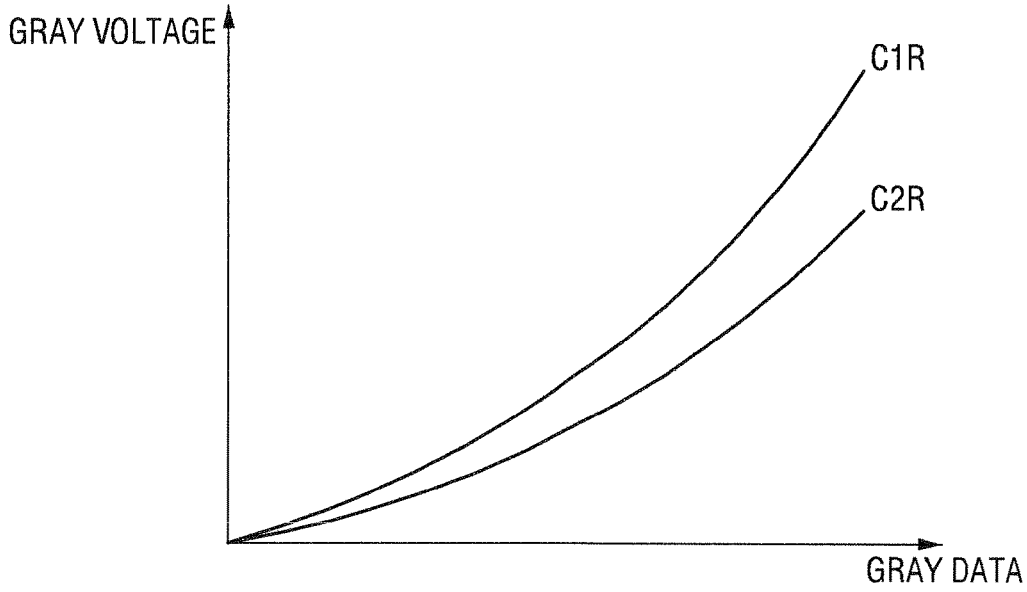
FIG. 6 is a graph illustrating a gamma curve for a red (R) color at C1 and C2 according to an embodiment of the present invention.
Figure 7:
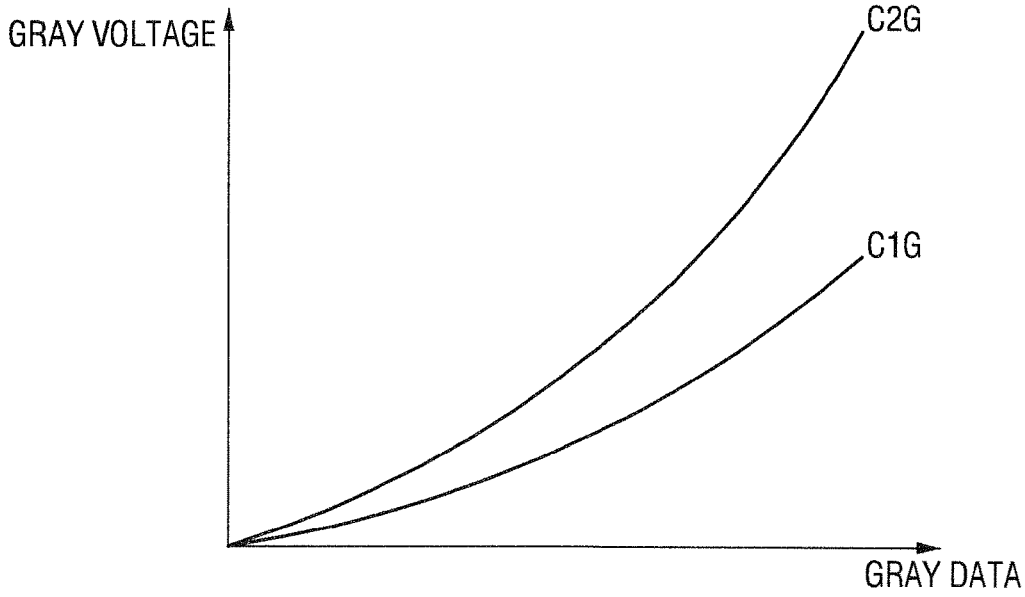
FIG. 7 is a graph illustrating a gamma curve for a green (G) color at C1 and C2 according to an embodiment of the present invention.
Figure 8:
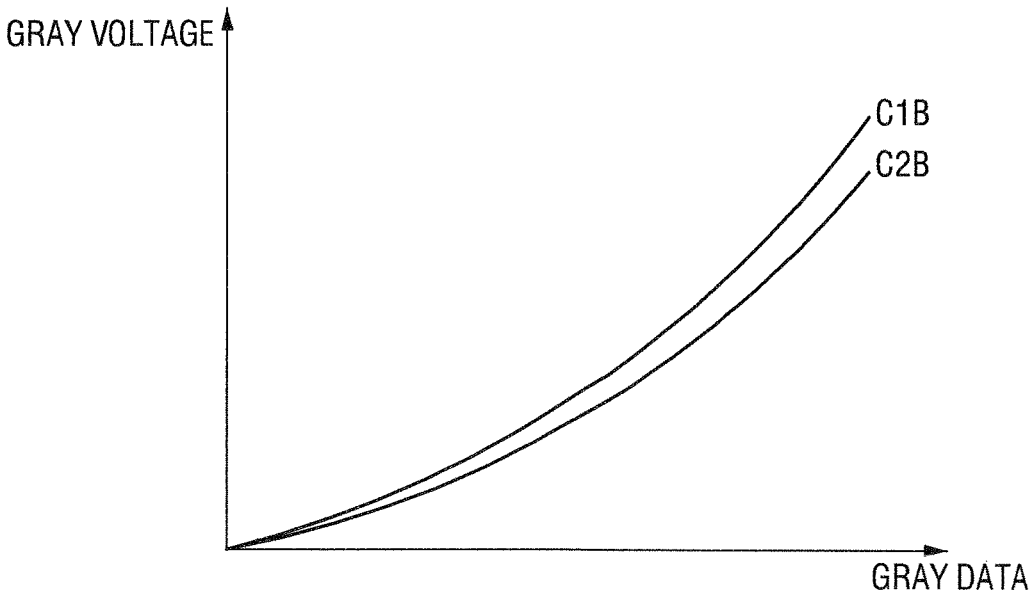
FIG. 8 is a graph illustrating a gamma curve for a blue (B) color at C1 and C2 according to an embodiment of the present invention.

FIG. 5 illustrates the color coordinate system according to an embodiment of the present invention, FIG. 6 is a graph illustrating a gamma curve for a red (R) color at C1 and C2 of FIG. 5 according to an embodiment of the present invention, FIG. 7 is a graph illustrating a gamma curve for a green (G) color at C1 and C2 of FIG. 5 according to an embodiment of the present invention, and FIG. 8 is a graph illustrating a gamma curve for a blue (B) color at C1 and C2 of FIG. 5 according to an embodiment of the present invention.

Referring to FIG. 5, on the color coordinate system, mixing ratios of a red (R) color may be arranged along the x axis of and mixing ratios of a green (G) color may be arranged along the y axis. A coordinate formed by arbitrary values of the x and y axes of the color coordinate system corresponds to the gamma curve of a color for the coordinate. For example, assuming that C1 of the coordinate (0.300, 0.310) is referred to a reference coordinate, R, G and B gamma curves corresponding to C1 are C1R, C1G and C1B shown in FIGS. 6 to 8, respectively. By contrast, R, G and B gamma curves corresponding to C2, which is a coordinate shifted from C1 in a minus (−) direction on the x axis and in a plus (+) direction on the y axis are C2R, C2G and C2B shown in FIGS. 6 to 8, respectively. Since C2 is shifted from C1 in a minus (−) direction on the x axis, C2R has a smaller gray scale voltage value than C1R, as shown in FIG. 6. Similarly, since C2 is shifted from C1 in a plus (+) direction on the y axis, C2G has a larger gray scale voltage value than C1G, as shown in FIG. 7. A distance in which C2 is shifted from C1 in the plus (+) direction on the y axis, is smaller than a distance in which C2 is shifted from C1 in the minus (−) direction on the x axis, suggesting that C1 has a reduced B component, compared to C2. Thus, as shown in FIG. 8, C2B has a smaller gray scale voltage value on the gamma curve than C1B.

The organic light emitting device may store gamma sets of a plurality of gamma curves corresponding to coordinates on the color coordinate system. The plurality of gamma sets may be stored in a memory 600, but aspects of the present invention are not limited thereto.

If image data for an image corresponding to C1 as a reference coordinate on the color coordinate system is transmitted to the data driver 200 and the gamma voltage generator 500 generates a gamma voltage GV corresponding to the gamma set of C1, the OLED panel 100, if it is in an ideal condition, may display an image corresponding to C1. Here, the image corresponding to C1 may be an image for displaying a color represented by C1 on the color coordinate system. However, even if the image data for an image corresponding to C1 as the reference coordinate on the color coordinate system is transmitted to the data driver 200 and the gamma voltage generator 500 generates a gamma voltage GV corresponding to the gamma set of C1 (which is to be referred to as configuration corresponding to C1, hereinafter), the OLED panel 100 may display an image corresponding to a coordinate different from C1 due to a product deviation of organic light emitting devices.

The organic light emitting device may display an image corresponding to C1 in the configuration corresponding to C1. In this case, the organic light emitting device according to an embodiment of the present invention may be configured to a gamma set corresponding to C3, which is a coordinate symmetrical to C2 with respect to C1. In the organic light emitting device of displaying the image corresponding to C2 in the configuration corresponding to C1, the color of the image is shifted from C1 to C2 to then be displayed. Therefore, a desired color can be displayed by offsetting a color deviation by adopting the gamma curve deduced from the gamma set of C3 corresponding to C2 with respect to C1. Likewise, in the organic light emitting device of displaying an image corresponding to C4 in the configuration corresponding to C1, the color deviation may be offset by configuring the organic light emitting device to a gamma set of C5, which is a coordinate symmetrical to C4 with respect to C1.

The color deviation may be identified through product inspection. In the configuration corresponding to a predetermined standard coordinate C1, a coordinate (C2, C4) corresponding to an image displayed from C1 may be detected by the product inspection. The organic light emitting device may memorize a coordinate C2 or C4 and obtain a coordinate C3 or C5 from C2 or C4 based on C1 and may read a gamma set of C3 or C5 from the coordinate C3 or C5. If the information regarding the gamma set of C3 or C5 is supplied to the gamma voltage generator 500, and the gamma voltage GV corresponding thereto is generated from the gamma voltage generator 500 to be supplied to the data driver 200, the color deviation of an image displayed on the OLED panel 100 may be offset, thereby displaying the image corresponding to C1. Therefore, the organic light emitting device according to an embodiment of the present invention can reduce the color deviation for different products. According to some embodiments, the organic light emitting device may memorize only the coordinate C3 or C5, which is previously deduced from the coordinate C2 or C4, without memorizing the coordinate C2 or C4. In this case, the organic light emitting device may read the gamma set corresponding to C3 or C5, without a step of obtaining C3 or C5 from C2 or C4. According to some other embodiments, the organic light emitting device may memorize only the gamma set corresponding to C3 or C5, without memorizing the coordinate C2 or C4 and the coordinate C3 or C5.

Referring back to FIG. 1, the organic light emitting device may further include the timing controller 300. The timing controller 300 may control the data driver 200 and the scan driver 400, which will later be described, to display a desired image on the OLED panel 100. The timing controller 300 may generate a data control signal DCS for controlling the data driver 200 to transmit the same to the data driver 200. The timing controller 300 may generate a scan control signal SCS for controlling the scan driver 400 to transmit the same to the scan driver 400.

The organic light emitting device may further include the scan driver 400. The scan driver 400 may receive the scan control signal SCS to then generate the scan signals S1, S2, . . . , Sn in response to the scan control signal SCS. The scan signals S1, S2, . . . , Sm are transmitted to the OLED panel 100 to control determination whether the plurality of pixels included in the OLED panel 100 are to receive the data signals D1, D2, . . . Dm or not.

The organic light emitting device may further include the memory 600. The memory 600 may store gamma sets corresponding to the respective coordinates on gamma sets corresponding to the respective coordinates on the color coordinate system, a coordinate of an image displayed on the color coordinate system in the configuration corresponding to a standard coordinate, a coordinate, which is symmetrical to the coordinate of the image displayed on the color coordinate system in the configuration corresponding to the standard coordinate with respect to the reference coordinate, and a gamma set corresponding to the coordinate, which is symmetrical to the coordinate of the image displayed on the color coordinate system in the configuration corresponding to the standard coordinate with respect to the reference coordinate.

The color coordinate system according to another embodiment of the present invention will now be described with reference to FIG. 9.

Figure 9:
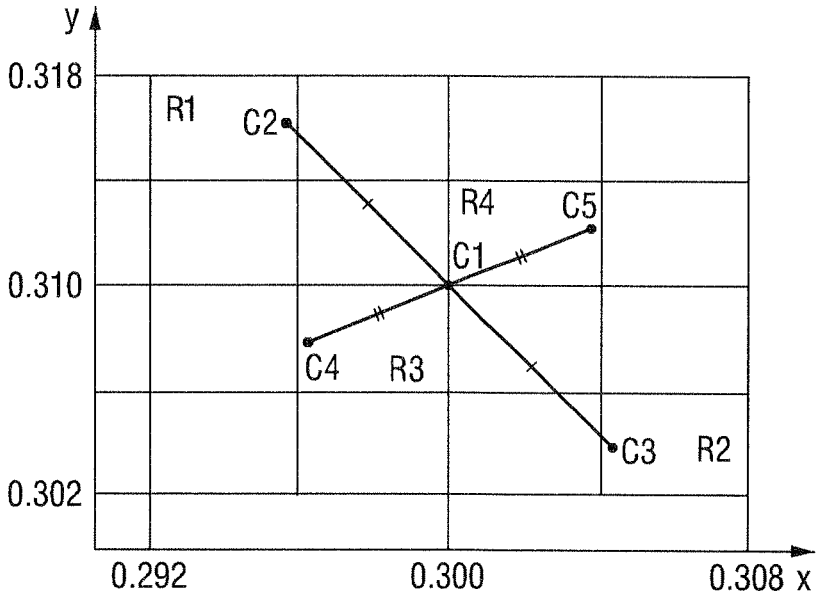
FIG. 9 illustrates the color coordinate system according to another embodiment of the present invention.

FIG. 9 illustrates the color coordinate system according to another embodiment of the present invention.

Referring to FIG. 9, the color coordinate system may include a plurality of regions arranged in a matrix type. A plurality of coordinates included in one region of the color coordinate system may correspond to one gamma set representing the region. According to some embodiments, a gamma set representing each region may be a gamma set corresponding to the central coordinate of the region. Referring to FIG. 9, the number of gamma sets to be stored in the organic light emitting device can be reduced, thereby reducing the amount of memory used in the organic light emitting device.

As shown in FIG. 9, an organic light emitting device of displaying an image corresponding to C2 in the configuration corresponding to C1 may be configured to a gamma set representing a region R2 including C3 symmetrical to C2 with respect to C1, thereby offsetting a color deviation. An organic light emitting device of displaying an image corresponding to C4 in the configuration corresponding to C1 may be configured to a gamma set representing a region R4 including C5 symmetrical to C4 with respect to C1, thereby offsetting a color deviation. Therefore, the organic light emitting device according to another embodiment of the present invention can reduce the amount of memory used while reducing a color deviation for different products.

A method of configuring a gamma set in an organic light emitting device according to an embodiment of the present invention will be described with reference to FIG. 10.

Figure 10:
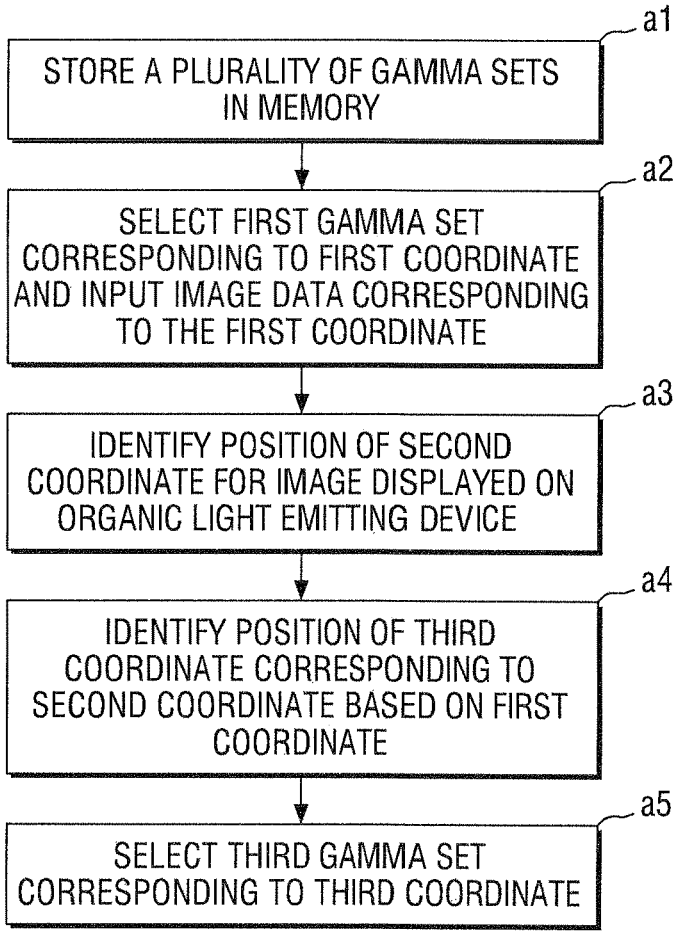
FIG. 10 is a flowchart illustrating a method of configuring a gamma set in an organic light emitting device according to an embodiment of the present invention.

FIG. 10 is a flowchart illustrating a method of configuring a gamma set in an organic light emitting device according to an embodiment of the present invention.

Referring to FIG. 10, the method of configuring a gamma set in an organic light emitting device may include (a1) storing a plurality of gamma sets in a memory. The plurality of gamma sets may include a plurality of gamma sets corresponding to various coordinates of the color coordinate system. According to some embodiments, the plurality of gamma sets may be a plurality of gamma sets representing a plurality of regions arranged in a matrix dividing the color coordinate system, respectively.

The method of configuring a gamma set in an organic light emitting may include (a2) selecting a first gamma set corresponding to a first coordinate on the color coordinate system and inputting image data corresponding to the first coordinate into the organic light emitting device. Here, the first coordinate may be a reference coordinate (C1).

The method of configuring a gamma set in an organic light emitting device may include (a3) identifying a position of a second coordinate (C2) of an image displayed on the organic light emitting device on the color coordinate system. C2 may vary with each product manufactured, thus the value of C2 must be determined in order to reduce the distribution of color characteristics by adjusting the gamma curve.

The method of configuring a gamma set in an organic light emitting device may include (a4) identifying a third gamma set corresponding to a third coordinate (C3) symmetrically matching with the second coordinate (C2) based on the first coordinate (C1). After determining C2, C3 is calculated from C1 and C2.

The method of configuring a gamma set in an organic light emitting device may include (a5) selecting a third gamma set corresponding to the third coordinate (C3) symmetrically matching with the second coordinate (C2) based on the first coordinate (C1). The gamma curve is changed to the gamma curve corresponding to C3.

The method of configuring a gamma set in an organic light emitting device according to an embodiment of the present invention may further include storing the third coordinate in the memory.

While the present invention has been particularly shown and described with reference to exemplary embodiments thereof, it will be understood by those of ordinary skill in the art that various changes in form and details may be made therein without departing from the spirit and scope of the present invention as defined by the following claims. It is therefore desired that the present embodiments be considered in all respects as illustrative and not restrictive, reference being made to the appended claims rather than the foregoing description to indicate the scope of the invention.

What is claimed is:

1. An organic light emitting device comprising:

an organic light emitting diode (OLED) panel displaying an image corresponding to a data signal;

a data driver receiving image data and a gamma voltage and generating the data signal; and a gamma voltage generator generating the gamma voltage, the gamma voltage corresponding to one selected from a plurality of gamma sets corresponding to a plurality of coordinates on a color coordinate system, wherein when a first gamma set corresponding to a first coordinate on the color coordinate system and the image data corresponds to the first coordinate, and the OLED panel displays an image corresponding to a second coordinate different from the first coordinate, the gamma voltage generator generates the gamma voltage corresponding to a second gamma set corresponding to a third coordinate symmetrical to the second coordinate with respect to the first coordinate.

2. The organic light emitting device of claim 1, wherein each of the plurality of gamma sets includes sub gamma sets corresponding to R (red), G (green) and B (blue) colors, respectively.

3. The organic light emitting device of claim 1, wherein the first coordinate is located at a position corresponding to 0.300 on a red axis and 0.310 on a green axis of the color coordinate system of the organic light emitting device.

4. The organic light emitting device of claim 1, further comprising a memory in which the plurality of gamma sets are stored.

5. The organic light emitting device of claim 4, wherein the second gamma set is stored in the memory.

6. The organic light emitting device of claim 4, wherein the third coordinate is stored in the memory.

7. The organic light emitting device of claim 4, wherein the second coordinate is stored in the memory.

8. The organic light emitting device of claim 1, wherein the OLED panel includes a plurality of organic light emitting diodes, the organic light emitting device further comprising a scan driver that generates a scan signal to determine whether the plurality of organic light emitting diodes are to receive the data signal or not.

9. The organic light emitting device of claim 8, further comprising a timing controller that controls the scan driver and the data driver.

10. An organic light emitting device comprising:

an organic light emitting diode (OLED) panel that displays an image corresponding to a data signal;

a data driver that receives image data and a gamma voltage and generates the data signal; and a gamma voltage generator that generates a gamma voltage corresponding to one selected from a plurality of gamma sets corresponding to a plurality of regions arranged in a matrix type and a first coordinate on a color coordinate system, wherein when a first gamma set corresponding to the first coordinate on the color coordinate system and the image data corresponds to the first coordinate, and the OLED panel displays an image corresponding to a second coordinate different from the first coordinate, the gamma voltage generator generates the gamma voltage corresponding to a second gamma set corresponding to a region including a third coordinate symmetrical to the second coordinate with respect to the first coordinate.

11. The organic light emitting device of claim 10, wherein each of the plurality of gamma sets includes sub gamma sets corresponding to R (red), G (green) and B (blue) colors, respectively.

12. The organic light emitting device of claim 10, the first coordinate is located at a position corresponding to 0.300 on a red axis and 0.310 on a green axis of the color coordinate system of the organic light emitting device.

13. The organic light emitting device of claim 10, further comprising a memory in which the plurality of gamma sets are stored.

14. The organic light emitting device of claim 13, wherein the second gamma set is stored in the memory.

15. The organic light emitting device of claim 13, wherein the third coordinate is stored in the memory.

16. The organic light emitting device of claim 13, wherein the second coordinate is stored in the memory.

17. The organic light emitting device of claim 10, wherein the OLED panel includes a plurality of organic light emitting diodes, the organic light emitting device further comprising a scan driver that generates a scan signal to determine whether the plurality of organic light emitting diodes are to receive the data signal or not.

18. The organic light emitting device of claim 17, further comprising a timing controller that controls the scan driver and the data driver.

19. A method of configuring a gamma set of an organic light emitting device, the method comprising:

storing a plurality of gamma sets corresponding to coordinates on a color coordinate system in a memory;

selecting a first gamma set corresponding to a first coordinate on the color coordinate system and inputting image data corresponding to the first coordinate into the organic light emitting device;

identifying a position of a second coordinate of an image displayed on the organic light emitting device on the color coordinate system; and selecting a third gamma set corresponding to a third coordinate symmetrical to the second coordinate with respect to the first coordinate.

20. The method of claim 19, further comprising storing the third coordinate in the memory.

* * * * *